United States Patent [19]

Bruce

[11] 4,395,789

[45] Aug. 2, 1983

[54] METHOD OF TREATING AND DYEING TEXTILE FABRICS

[75] Inventor: Bengt-Ake Bruce, Ljungby, Sweden

[73] Assignee: Aktiebolaget Electrolux, Stockholm, Sweden

[21] Appl. No.: 71,842

[22] Filed: Sep. 4, 1979

Related U.S. Application Data

[62] Division of Ser. No. 941,965, Sep. 13, 1978, abandoned.

[30] Foreign Application Priority Data

Sep. 13, 1977 [SE] Sweden ..... 7710245

[51] Int. Cl.[3] ..... D06B 5/24; D06B 5/26

[52] U.S. Cl. ..... 8/159; 68/24; 68/58

[58] Field of Search ..... 68/12 R, 24, 16, 58; 8/158, 159

[56] References Cited

U.S. PATENT DOCUMENTS

| | | | |
|---|---|---|---|
| 3,172,277 | 3/1965 | Burkland | 68/24 X |
| 3,388,410 | 6/1968 | Marshall | 8/158 |
| 3,919,864 | 11/1975 | Pellerin | 68/16 X |

*Primary Examiner*—Philip R. Coe
*Attorney, Agent, or Firm*—Alfred E. Miller

[57] ABSTRACT

A method for dyeing of textiles in a liquid bath and an apparatus for performing the process which effectively stirs the dye bath resulting in a more homogeneous color distribution in the bath. The method also results in a faster drying process of the goods. Thus, the dyeing processing time has been reduced while the dyeing of the goods has been made more uniform.

1 Claim, 2 Drawing Figures

METHOD OF TREATING AND DYEING TEXTILE FABRICS

This is a division of application Ser. No. 941,965, filed Sept. 13, 1978, now abandoned.

BACKGROUND OF THE INVENTION

According to a known process for dyeing textiles in a liquid bath, the goods are inserted in a perforated drum which is rotatably mounted on a horizontal shaft in a closed container, the latter being closable by means of a door. If needed, the goods are pretreated in the drum and thereafter the steps of washing, rinsing and centrifugally drying of said goods are performed and a treating liquid consisting of cold or tempered water, coloring material and other additives required in the dyeing process are supplied into the drum, and then the drum is operated to rotate slowly. Generally, the liquid is then heated to a predetermined temperature, either at an uncontrolled or at a controlled rate. The temperature set is then retained during the whole, or during parts of the dyeing process, during which the drum is rotated intermittently and in opposite directions of rotation. Preferably, the process is controlled automatically by a program controller whereby temperatures set, liquid levels, process times and other parameters are controlled. The dyeing process is completed by rinsing and spin drying of the textile goods.

For the purpose of dyeing ready-made textile garments, common washing machines of the rotating drum type have often been used, which have been modified for this purpose. Accordingly, such washing machines have been provided with means for dispensing coloring material and other additives and, moreover, advanced control equipment has been provided for automatic guiding and control of dyeing processes including a number of adjustable process parameters.

In known textile dyeing processes performed in machines comprising a drum which is rotatably mounted on a horizontal shaft the rotating speed of the drum must be kept low number of revolutions per minute due to the fact that the dyeing process must not result in changes in the various qualities of the textile garments. However, a low rotating speed results in an ineffective stirring of the liquid bath causing both uneven temperature distribution in the drum and unequal dyeing of the garments.

The present invention relates to a process for treatment of textiles in a liquid bath, particularly for dyeing of such textile goods. The invention also concerns a machine for performing the foregoing process.

An object of the invention is to provide a process for treatment of textile garments in a liquid bath, as well as a machine for performing the process which will make possible a more effective stirring of the liquid bath, and as a result a more homogeneous color distribution in said bath.

Another object of the present invention is to obtain a faster dyeing process of the textile goods.

The above desirable objects have been achieved in that the process, as well as the machine, have features resulting in the present novel method and apparatus. As an example, the invention has resulted in dyeing of textile garments which has been so effective that the entire processing time has been reduced, and simultaneously the dyeing process as applied to textile garments has been more uniform.

In order that the invention will be more clearly understood, it will now be disclosed in greater detail with reference to the accompanying drawings, in which:

FIG. 1 is a perspective view of a machine constructed in accordance with the teachings of the present invention, and FIG. 2 is a circuit showing a wiring diagram for connecting the various means required for performing the present process.

DESCRIPTION OF THE PREFERRED EMBODIMENT

Figure 1:
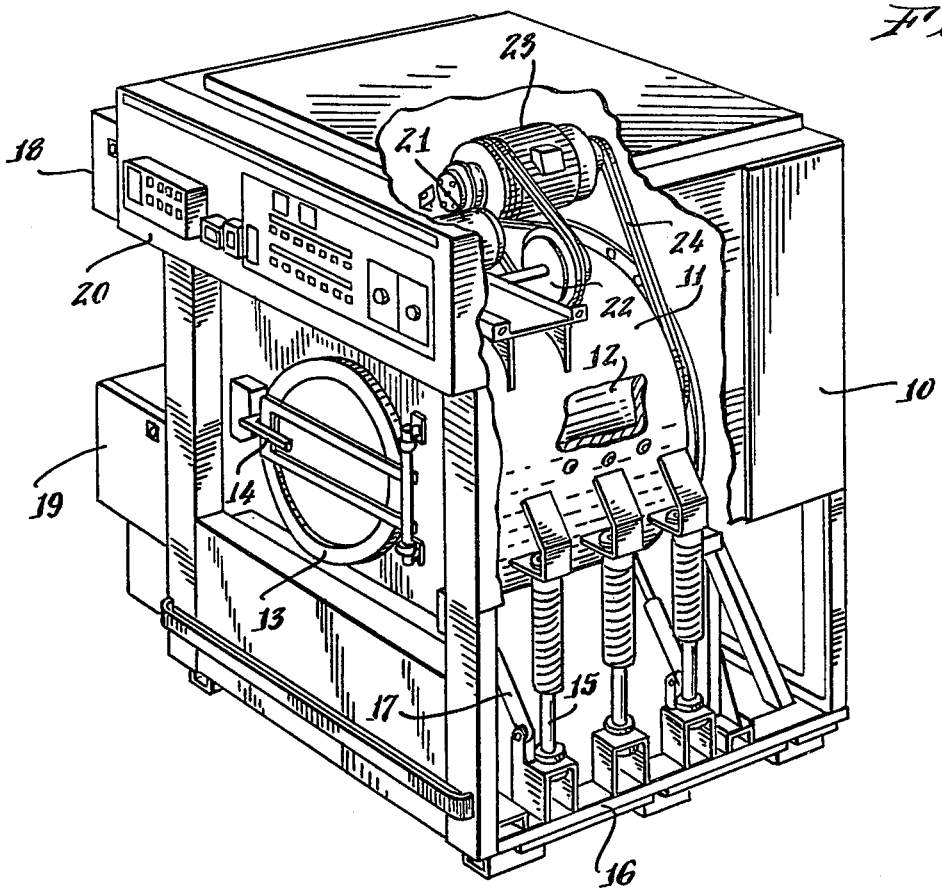

In FIG. 1 a conventionally assembled drum washing machine is shown which has been modified for use in dyeing processes for textile fabrics or garments. The machine comprises an outer housing 10 which encloses a vat 11 in which a drum 12 is mounted on a horizontally rotatable shaft (not shown). The drum is open in the end facing the front of the machine and is accessible for inserting and removing of textile goods through a door 13 that is operated by a handle 14. The vat 11 is resiliently suspended in the outer housing 10 by means of a number of spring legs 15, one end of each being secured to a bottom frame 16 which is a part of the housing 10. Moreover, shock absorbers 17 are provided for dampening of the movement of the vat 11.

For the dispensing of coloring material, salts and other additives dosing units 18, 19 are provided, said units being shown only diagrammatically in the drawing.

The dyeing processes taking place in the machine may be controlled either manually or automatically in the usual manner by program controllers, preferably controlled by programmable cards (not shown). The manual control of the machine as well as the setting of various process parameters, such as temperatures, liquid levels, etc. may be carried out on a control panel 20 provided on the front side of the machine.

The machine is driven by a DC motor 21 which is connected to the drum 12 by a belt 24 by means of a gearing 22 and an asynchronous motor acting as a spin-drying motor 23. Moreover, the machine is provided with coupling means (not shown) for the electrical installations as well as for the supply of cold and warm water, and for draining off waste water.

Figure 2:
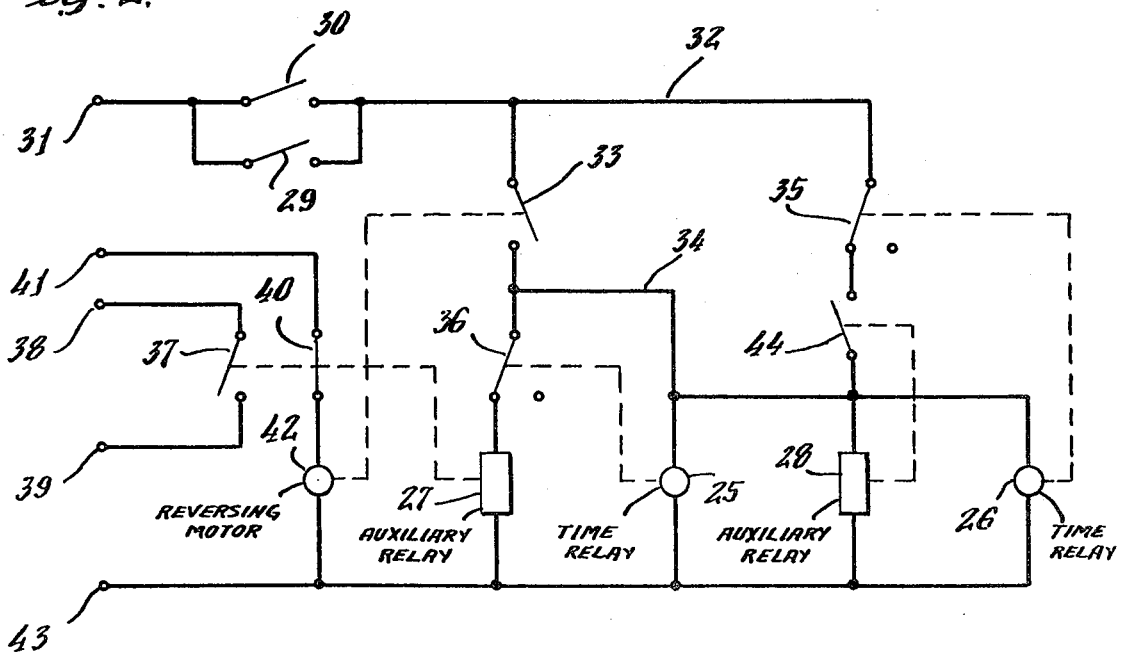

In the present method, during a dyeing process, when rotating with a low rotational speed, the drum 12, for short periods of predetermined intervals, should be brought into rotation at a distributing rotational speed selected so that the textile goods are distributed along the periphery of the drum and are pressed against said periphery by centrifugal force in order that no relative movement will exist between the goods and the drum during the rotation at higher speed. This is of major importance for preventing damage to the textile goods. FIG. 2 is a circuit diagram showing how it is possible to operate the motor 21 to rotate at distributing speed, either automatically or manually. This is achieved by means of two time relays 25, 26 and two auxiliary relays 27, 28. Time relay 25 is used for setting the time interval during which the drum is to rotate at the distributing speed, for example 10 seconds, whereas time relay 26 is used for determining the cycle time, i.e., the time interval between two consecutive time points at which the distributing speed of the motor is switched on, for example 120 seconds. The total time during which the distributing speed is to be periodically switched on may be determined manually through a switch 29 or automatically by a program controller contact 30. When either of the contacts 29 or 30 is closed, voltage is applied from a terminal 31 to a conductor 32 through which said voltage through a contact 33 is applied to a conductor 34. Conductor 34 is directly connected to one of the magnetizing terminals of each of time relays 25, 26 and of auxiliary relay 28. The remaining magnetizing terminal of relays 25, 26 and 28 are connected to a common ground terminal 43. The auxiliary relay 28 is also connected to conductor 32 via a self energizing contact 44 and a further contact 35 operated by time relay 26. The auxiliary relay 27 is connected to conductor 34 through a contact 36 operated by the time relay 25. The auxiliary relay 27 controls via a contact 37 the application of supply current from a terminal 38 via a terminal 39 to a thyristor control circuit for the motor 21. Moreover, relay 27 through a contact 40 controls the switching off of a reversing motor 42 which is supplied with voltage via a terminal 41. The reversing motor 42 is provided for controlling the reversing movement of the motor 21 and hence the movement of drum 12 during the dyeing process. Moreover, the reversing motor 42 controls the position of contact 33, which is a necessity for the reason that the distributing speed may be switched on only when drum 12 is rotating, i.e. when reversing motor 42 is functioning.

Referring to the wiring diagram of FIG. 2, the following function of the textile dyeing machine can be determined: The desired cycle time for example 120 seconds is set on time relay 26 and the desired process time at distributing, for example 10 seconds is set on time relay 25. Upon the closing of switch 29, or program controller contact 30, voltage is applied to conductor 32. When the reversing motor 42 is operational, contact 33 is closed and conductor 34 is supplied with voltage and the motors of time relays 25 and 26 are started. In addition, auxiliary relay 28 receives voltage and closes contact 44, whereby relay 28 is connected to conductor 32 via the normally closed contact 35, and thus relay 28 receives a self-holding magnetizing current.

At the same time as voltage is applied to time relay 25 voltage is also supplied to auxiliary relay 27 which closes contact 37 for switching on the distributing speed of the motor. Simultaneously, contact 40 opens and accordingly reversing motor 42 is stopped from operating resulting in the opening of contact 33. However, auxiliary relay 27 as well as time relay 25 will receive current from conductor 32 through contacts 35 and 44, and this condition will not be changed until time relay 25 opens contact 36 at the end of its working cycle. As a result of this occurrence relay 27 drops causing contact 40 to close and contact 37 to open whereby motor 21 will return to the state in which the drum 12 is rotated at a low speed. Time relay 25 continues to have voltage applied thereto via contacts 35 and 44 while contact 36 is open, and this condition remains until time relay 26, at the end of the timing cycle, opens contact 35 and breaks the supply of voltage to the two time relays 25, 26 as well as to the auxiliary relay 28. Contact 36 is again closed, and when the reversing motor 42 closes contact 33, a new process can begin.

It is not intended to be limited by the embodiment shown and described herein, but the scope of the invention is to be determined by the following claims.

What is claimed is:

1. The method for dyeing textile fabrics in a liquid bath wherein said fabrics are placed in a perforated drum that is rotatably mounted on a horizontal shaft in a closed container having a door, comprising the steps of: bringing a textile dyeing liquid into said drum, rotating said drum at tumbling speed, increasing the rotating speed of the drum repeatedly during short periods of time from a tumbling speed to a speed level whereby the fabrics are distributed about the inner periphery of the drum and pressed against said periphery to avoid relative movement between the fabrics and the drum, draining off said treatment liquid, and extracting the remaining humidity from the textile fabrics.

* * * * *